US005114040A

United States Patent [19]

Brenish et al.

[11] Patent Number: 5,114,040

[45] Date of Patent: May 19, 1992

[54] HOPPER FOR DISPENSING CEMENT OR MORTAR

[76] Inventors: Michael Brenish, 85 Penningtor Ave., Passaic, N.J. 07055; Frank Herzig, 64 Douglas Dr., Towaco, N.J. 07082

[21] Appl. No.: 637,820

[22] Filed: Jan. 7, 1991

[51] Int. Cl.[5] ..... B67B 7/00

[52] U.S. Cl. ..... 222/1; 222/611.2; 222/185; 222/559; 222/466; 222/409; 401/193; 118/207; 118/305

[58] Field of Search ..... 222/611.1, 611.2, 185, 222/460-462, 501, 510, 322, 601, 608, 625, 544, 547, 559, 564, 409, 465.1, 466; 141/250; 401/193; 118/207, 305

[56] References Cited

U.S. PATENT DOCUMENTS 151,372 5/1874 Eyrse .
1,164,497 12/1915 Bechtel .
1,306,319 6/1919 Tittle, Jr. ..... 222/185 X
3,162,886 12/1964 Wise ..... 222/611.2 X
3,791,559 2/1974 Foye ..... 222/611.2
3,920,161 11/1975 Kenzian ..... 222/608
4,135,651 1/1979 Hession et al. ..... 401/193 X
4,294,383 10/1981 Hession et al. ..... 222/611.1
4,352,445 10/1982 Cusumano et al. ..... 401/193 X
4,630,965 12/1986 Nguyen et al. ..... 222/611.1 X

*Primary Examiner*—David H. Bollinger
*Attorney, Agent, or Firm*—Thomas L. Adams

[57] ABSTRACT

A hopper dispenses cement or mortar into the space between side by side paving bricks. The hopper is a self supporting container. The container has opposing container sides converging downwardly to an elongated opening. This elongated opening extends for most of the length of the container. The opening has just below it a spaced pair of thin parallel guides for guiding the cement or mortar into the space between the paving bricks.

27 Claims, 3 Drawing Sheets

HOPPER FOR DISPENSING CEMENT OR MORTAR

BACKGROUND OF THE INVENTION

The present invention relates to a hopper for dispensing cement or mortar, and in particular, to apparatus for dispensing material in the spaces between workpieces, such as paving bricks.

Cementing the space between paving bricks makes the resulting surface continuous and keeps the bricks in place. Unfortunately, filling the space between paving bricks is extremely tedious. Cement must be kept off the top of the bricks for good appearance. Also the space between bricks must be carefully filled with cement to eliminate voids that can become infiltrated with water. Freezing water can crack the joint between bricks. Because of the extensive labor involved in cementing the space between paving bricks, this procedure is often prohibitively expensive.

Known machines can lay mortar atop a row of building blocks. These machines ride atop the blocks and lay parallel beads of mortar. Unfortunately, these machines are unable to lay cement between paving bricks.

Another known machine (U.S. Pat. No. 4,630,965) employs a cylindrical drum with a trailing pipe having a nozzle for dispensing sealant into cracks in concrete slabs. This device is unable to dispense cement between paving bricks.

See also U.S. Pat. Nos. 151,372; 1,164,977; 3,162,886; 3,791,559; 3,920,161; 4,135,615; 4,294,383, 4,352,445; and 4,630,965.

Accordingly, there is a need for equipment for simply and rapidly dispensing cement or mortar between workpieces such as paving bricks.

SUMMARY OF THE INVENTION

In accordance with the illustrative embodiments demonstrating features and advantages of the present invention, there is provided a hopper for dispensing cement or mortar into the space between side by side workpieces. The hopper includes a self supporting container having an opposing pair of container sides. These container sides converge downwardly to ar elongated opening that extends for most of the length of the container. This opening has just below it a spaced pair of thin parallel guides for guiding the cement or mortar into the space between the workpieces.

In a related method of the same invention, mortar or cement can be dispensed between paving bricks with a plunger and a hopper having an elongated opening. The method includes the step of loading mortar or cement into the hopper. Another step is positioning the hopper with its elongated opening between adjacent ones of the paving bricks. The method also includes the step of reciprocating the plunger to force some of the cement or mortar through the elongated opening and between the paving bricks.

By employing apparatus and methods of the foregoing type, an improved technique is achieved for dispensing cement or mortar between workpiece such as paving bricks. In a preferred embodiment, a container with slanted sides converges at an elongated opening. The elongated opening has metal tongues that intervene between the paving bricks. The preferred embodiment has a plunger in the form of a transverse bar with a flat bottom. A mason uses a vertical handle on the transverse bar to reciprocate the bar and push cement or mortar through the opening in the bottom of the hopper.

A longer hopper can dispense cement at the long sides of paving bricks. This hopper can be slid along the brick joint; the plunger bar can be pressed into the opening to close it during hopper movement. A smaller hopper can dispense cement at the shorter edge of the bricks. The mason lifts and moves this hopper to different positions. Again, the plunger can close the hopper opening when repositioning.

The hopper preferably has a high degree of adjustability. In the preferred embodiment, legs on opposite sides of the hopper support a skid. The leg height is adjusted by first removing the leg assembly from studs on the outside of the hopper. The leg assembly is reinstalled at a different height by mounting it on different holes in its mounting plate. Instead of numerous holes, the leg assembly may employ a slot for adjustment.

Also in this preferred embodiment, the width of the lower opening can be adjusted to match the brick to brick spacing. In this embodiment, the hopper is formed from two complementary half shells that are pivotally connected. The two shells can swing relatively in a jaw-like fashion. A wing nut is used to clamp the two shells together to set the opening at a desired width.

BRIEF OF DESCRIPTION OF THE PREFERRED DRAWINGS

The above brief description as well as other objects, features and advantages of the present invention will be more fully appreciated by reference to the following detailed description of presently preferred, but nonetheless illustrative embodiments in accordance with the present invention when taken in conjunction with the accompanying drawings wherein.

DETAILED DESCRIPTION OF THE PREFERRED EMBODIMENTS

Figure 1:
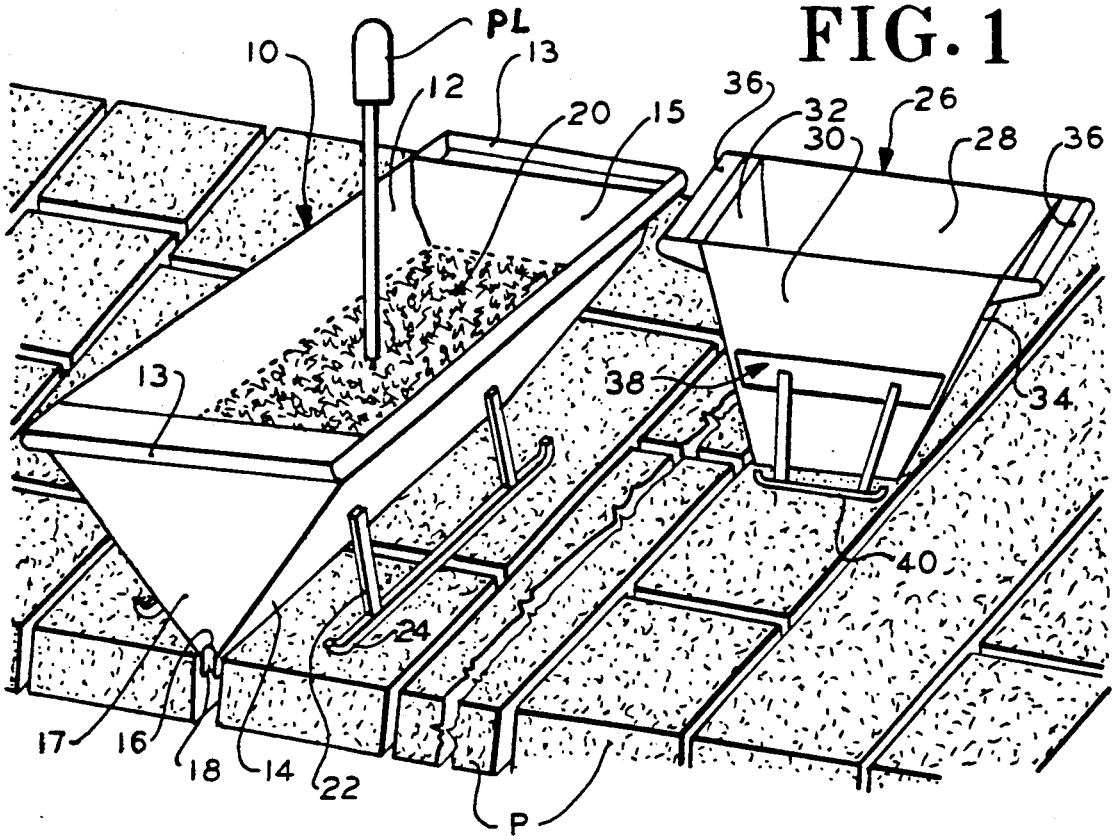
FIG. 1 is a perspective view of two differently sized hoppers atop workpieces (i.e. paving bricks) in accordance with the principles of the prevent invention.

Referring to FIG. 1, a field of paving bricks P, also referred to as workpieces, are shown laid in the usual staggered fashion. A hopper is shown herein as a large container 10 having container sides 12 and 14 that converge to a longitudinal opening 16. Mounted below and adjacent to opening 16 are a pair of thin parallel guides 18. The guides are preferably made of metal strips that are 0.025 inch thick. The strips can be affixed by epoxy, riveting or molded to the bottom of the hopper. This type of arrangement can work with a very narrow brick joint of only ⅛ inch and still easily fill the joint.

In some embodiments, the hopper can be made with a fixed space between the guides. For example, hoppers can be designed with guide to guide spacings of ⅛, ⅜ or ½ inch; although any fixed spacings between 0 to ¾ of inch may be chosen. In this example, the vertical dimension of the guides can be ⅜ inch with an expectation of a 3/16 inch insertion below the top level of the paving bricks.

Hopper 10 has approximately triangular end cheeks 15 and 17. The triangular end cheeks 15 and 17 are inclined so that the length at the longitudinal opening 16 is somewhat less then the overall length at the top. The overall length of hopper 10 at the bottom is approximately 6¾ inches to approximately match the typical length of a paving brick. The overall height of the hopper is 6 inches and the overall length at top is 10 inches. Mounted adjacent to cheeks 15 and 17 are handles 13 for moving the hopper. The hopper is preferably made from sheet metal, although plastics or other materials can be used instead.

Affixed to container sides 12 and 14 are a pair of support members, shown herein as leg assembly 22, comprising a pair of struts supporting a skid 24. Assembly 22 can be molded as one piece of plastic or fabricated from plastic. The length of the skid 24 is preferably 7 inches. The supporting members, shown as legs ending in skids, can either be molded plastic or metal. The supporting members can be bolted, welded, glued, riveted or otherwise fastened to the container sides. In some embodiments, the supporting members may take the shape of a simple plate.

Hopper 10 is filled with a cement mixture 20, although mortar may be used in some applications. Emerging from cement 20 is a plunger PL, which is disclosed hereinafter in further detail.

A smaller plastic hopper 26 is shown with converging container sides 28 and 30 also meeting in an elongated opening (not shown) similar to that of hopper 10. Hopper 26 also has approximately triangular end cheeks 32 and 34. Again, mounted adjacent to cheeks 32 and 34 are handles 36. Hopper 26 also has support members 38, which include a pair of skids (only skid 40 is visible). Support member 38 keeps hopper 26 in an upright position.

The overall length of hopper 26 is about 3⅜ inches to approximately match the width of a typical paving brick. For hopper 26 the length of the elongated opening is somewhat less then the overall length of the hopper at its top. The overall length at the top is 6 inches with an overall height (excluding the guides) of 5 inches. The smaller hopper can be used not only to dispense cement between paving bricks but also between flagstones or into cracks in concrete slabs.

The foregoing hoppers can be constructed in various fashions. In some embodiments, the hopper may be formed of a molded thermoplastic that is resistant to the abrasion and caustic nature of the cement or mortar. Alternatively, the hopper can be fabricated from sheet plastic that is cut and glued together to form the shapes illustrated. Alternatively, the hopper can be formed of sheet metal, which is cut to size, folded and spot welded or riveted together to produce the illustrated shapes.

Figure 2:
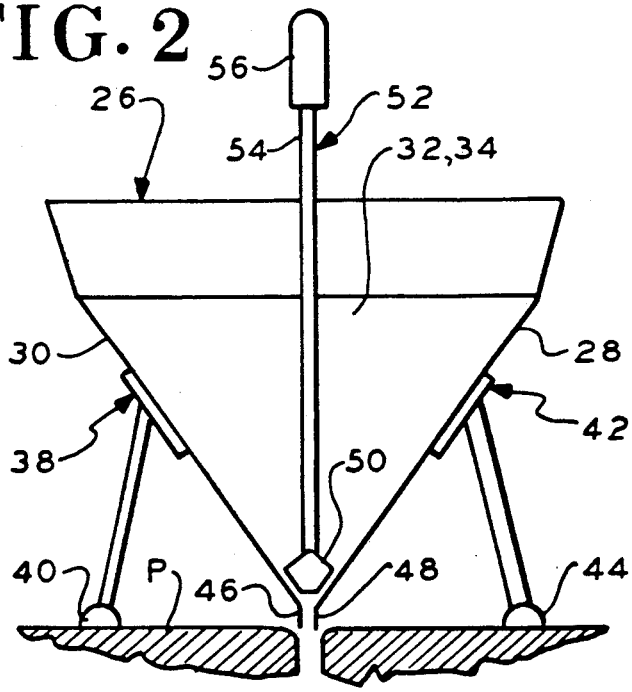
FIG. 2 is a schematic cross sectional view of the smaller hopper of FIG. 1.

Referring to FIG. 2, previously illustrated smaller hopper 26 is shown schematically in cross section. In this view, support members 38 and 42 are shown attached to container sides 30 and 28, respectively, and terminate in skids 40 and 44, respectively. Visible in this view is the elongated opening 46 below which are mounted a pair of thin parallel guides 48.

Plunger 52 is shown having a transverse bar 50 that has a five-sided, polygonal cross section. The transverse bar is a prism with truncated ends that are slanted to match the slant of end cheek 32 and 34 of the hopper. Plunger 52 has approximately an overall height of 10 inches. The length of the transverse bar is preferably 3½ inches long at the top with a lower length of 3¼ inches. Plunger 52 has a cylindrical rod 54 that forms a handle terminating in an upper grip 56.

Figure 4:
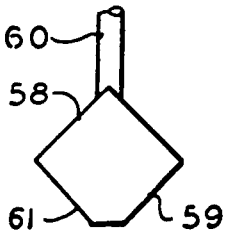
FIG. 4 is a detailed end view of the transverse bar of the plunger of FIG. 3.
Figure 3:
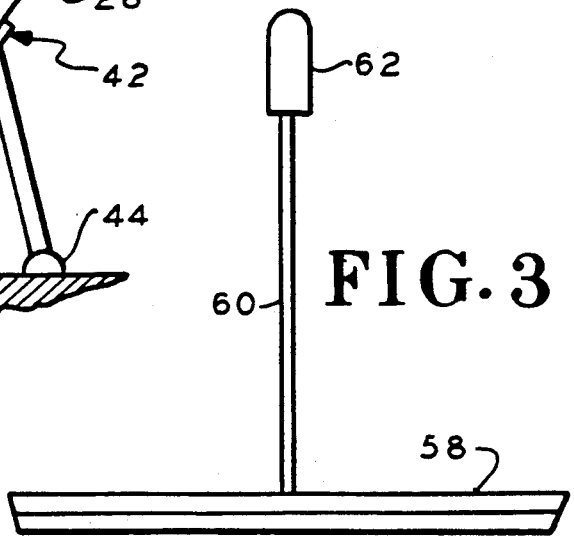
FIG. 3 is a side view of the plunger of FIG. 1.

Referring to FIGS. 3 and 4, the plunger PL previously illustrated in FIG. 1 is shown having a transverse bar 58 having the same cross section as illustrated for plunger 52 of FIG. 2. Plunger PL, however, is substantially longer to match the greater length of its associated hopper. Plunger PL has a cylindrical rod 60 forming a handle terminating in an upper grip 62. In a preferred embodiment, transverse bar 58 has an overall top length of 6 9/16 inches and a lower length of 6 7/16. The overall height of the transverse bar 58 is ⅜ inch with an overall thickness of 1 inch. The flat bottom is ⅜ inch wide. The overall height of the plunger from handle to flat bottom is 12 inches.

Figure 5:
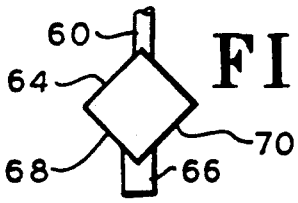
FIG. 5 is an end view of a transverse bar that is in an alternate to that of FIG. 4.

Referring to FIG. 5, the transverse bar previously illustrated in FIG. 4, is shown in a modified form. In this embodiment, bar 64 has depending from it a rectangular prism referred to as a rectangular prismatic boss 66. It is important to note that the boss is too big to be inserted into the space between guides. Should the boss enter the space between the guides, it would tend to cause a suction when pulled upwardly. This suction makes it difficult to keep cement between the bricks.

In FIGS. 4 and 5 the transverse bars both have a compound underside, but in each case the lowest surface comprises a flat bottom with adjacent side surfaces. FIG. 4 shows side surfaces 59 and 61 and FIG. 5 shows side surfaces 68 and 70. The tapered sides and ends of the transverse bars match the converging sides of the hopper to cause a valve action, sealing the elongated opening when the plunger is in its lowermost position.

Figure 6:
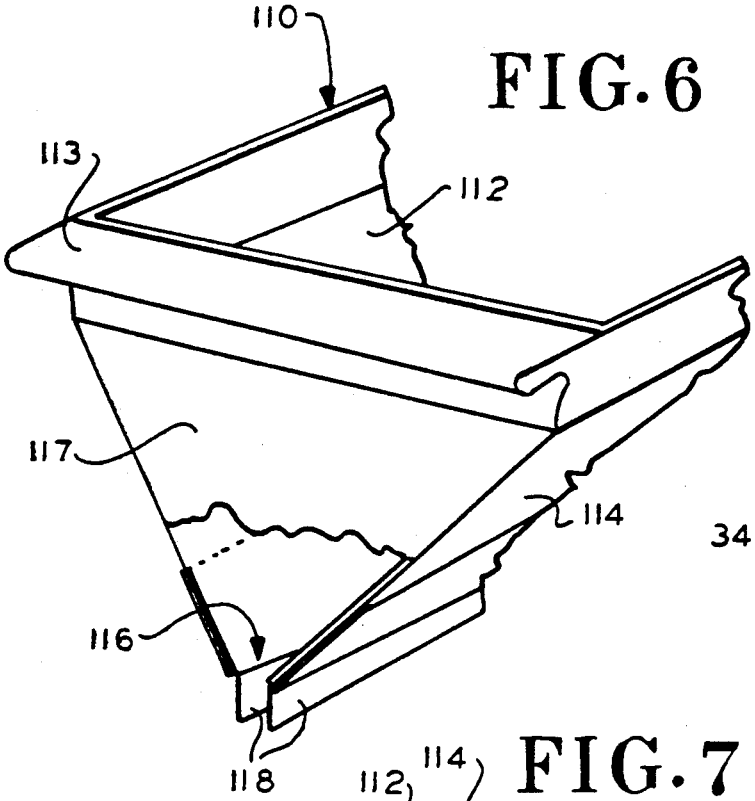
FIG. 6 is a fragmentary perspective view of a hopper that is an alternate to that of FIG. 1.
Figure 7:
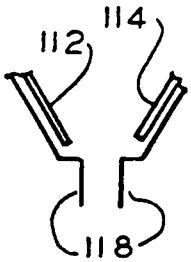
FIG. 7 is a detailed, cross sectional view of the opening of the hopper of FIG. 6.

Referring to FIGS. 6 and 7, a modified larger hopper is illustrated. In this view, parts corresponding to the previously illustrated large hopper of FIG. 1 are indicated by a reference numeral increased by 100. The handle 113 has been modified to be a smooth extrusion having a concave underside to act as a finger pull or rest. Handle 113 is secured to the end cheek 117.

A parallel pair of thin guides 118 is shown as sheet metal side pieces secured to the outside faces of container sides 112 and 114. As illustrated, especially in FIG. 7, guides 118 have an upper slanted face, a horizontal jog and a vertical guide face. In this embodiment, the guide to guide spacing of guides 118 is fixed.

Figure 8:
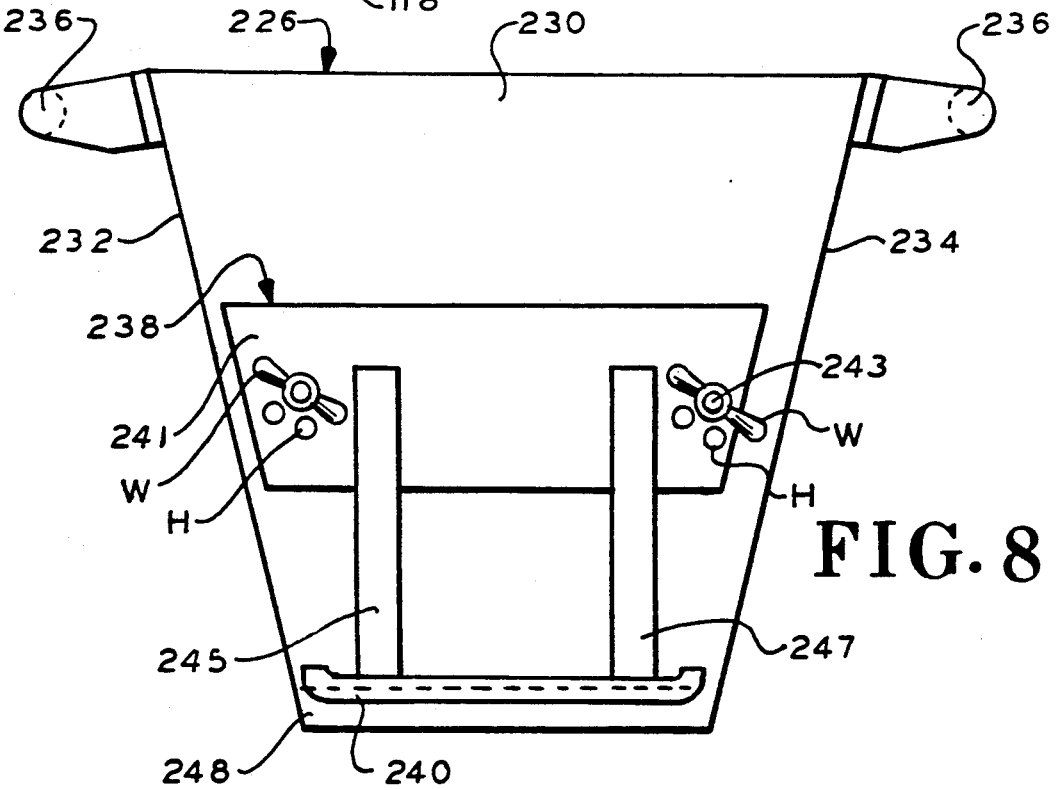
FIG. 8 is a side view of a small hopper similar to that of FIG. 2, but modified to have adjustable support members.

FIG. 8 shows a small hopper that is an alternate to hopper 26 of FIG. 1. In this embodiment, similar components have the same reference numeral, but increased by 200. As before, hopper 226 if formed of end cheeks 232 and 234. One container side 230 is also illustrated. Handles 236 are the same as previously illustrated.

A front elevational view of support member assembly 238 is shown, the end appearance being the same as shown in FIG. 2, except that wing nuts W are not used in that view. The top of plate 241 is located about 3¼ inches from the bottom of the skid 240. The overall length of the plate can be 4 7/16 inches, while the skid length can be 3⅜ inches. (For the larger hopper, the plate can have an overall length of about 8 inches; and the elevation of the top of the plate when installed on the hopper can be 3 ⅞ inch). It will be understood, however, that other dimensions are possible depending upon the size of the hopper, the desired stability, strength etc.

As before, side plate 241 supports a pair of struts 245 and 247. Struts 245 and 247 emerge from the side of plate 241 at about a 60° angle from the surface of the plate. The lower ends of struts 245 and 247 terminate in a skid 240, which is the same as that previously illustrated in FIG. 1.

Plate 241 has two trios of holes H near opposite edges of the plate. The holes H are spaced to match the spacing of threaded studs 243, which project from the side 230 (as well as the unillustrated side opposite side 230).

Wing nuts W are threaded over studs 243 to hold the plate 241 in place, thereby setting the height of support member 238. Clearly, wing nuts W can be removed and a different pair of holes H can be selected to raise member 238, thereby lowering guides 248. While wing nuts W are illustrated, in other embodiments alternate fasteners can be used instead. With the triple hole arrangement, the depth of insertion of the guides are preferably 3/16, 5/16 or 7/16 inch; other insertion depths are possible, however.

Figure 9:
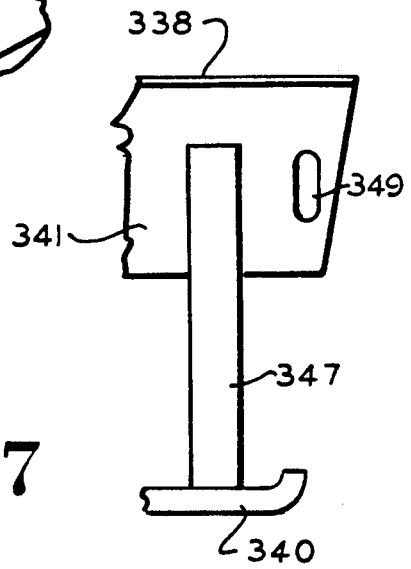
FIG. 9 is a detailed fragmentary view of a support member that is an alternate to that of FIG. 8.

Referring to FIG. 9, an alternate support member 338 is illustrated. The reference numerals of components in this figure corresponding to those of FIG. 8 have their most significant digit changed to 3. Strut 347 and skid 340 are constructed the same as previously illustrated. Plate 341, however, is modified to have instead a pair of slots 349. The slot length is preferably ½ inch. Accordingly, plate 341 can be mounted on the previously illustrated studs. Wing nuts or other fasteners can be clamped on the stud and the slot 349 will allow vertical adjustment of the member 338.

Figure 11:
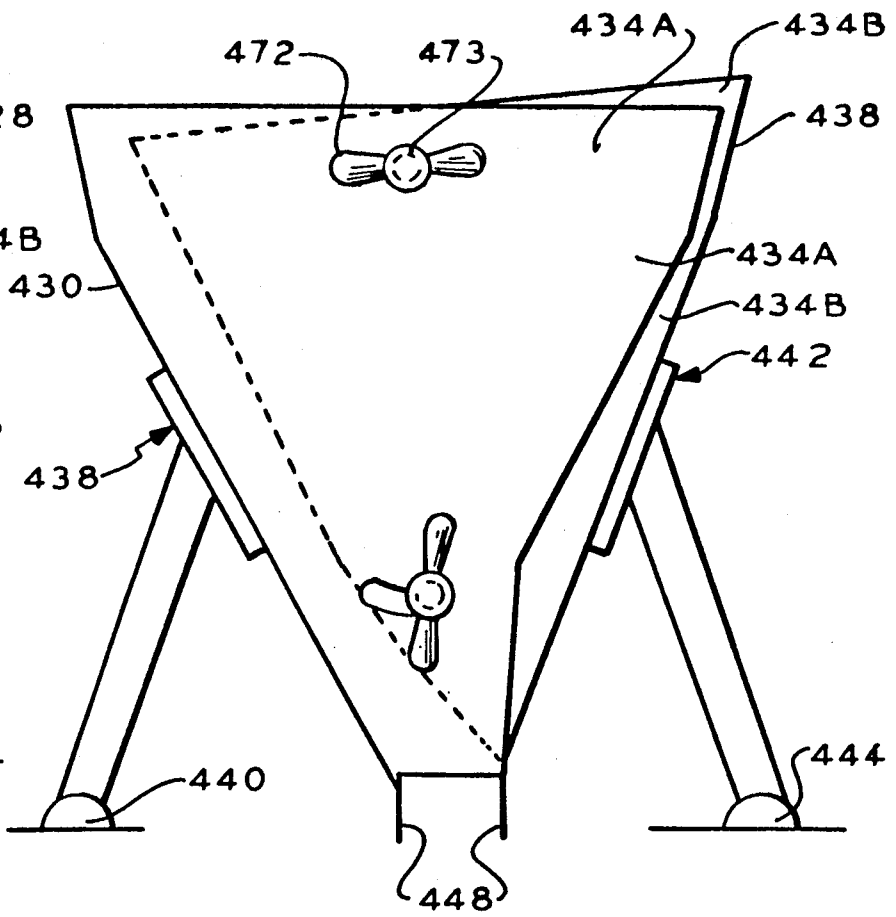
FIG. 11 is an end view of the hopper of FIG. 10, swung to its maximum opening.
Figure 10:
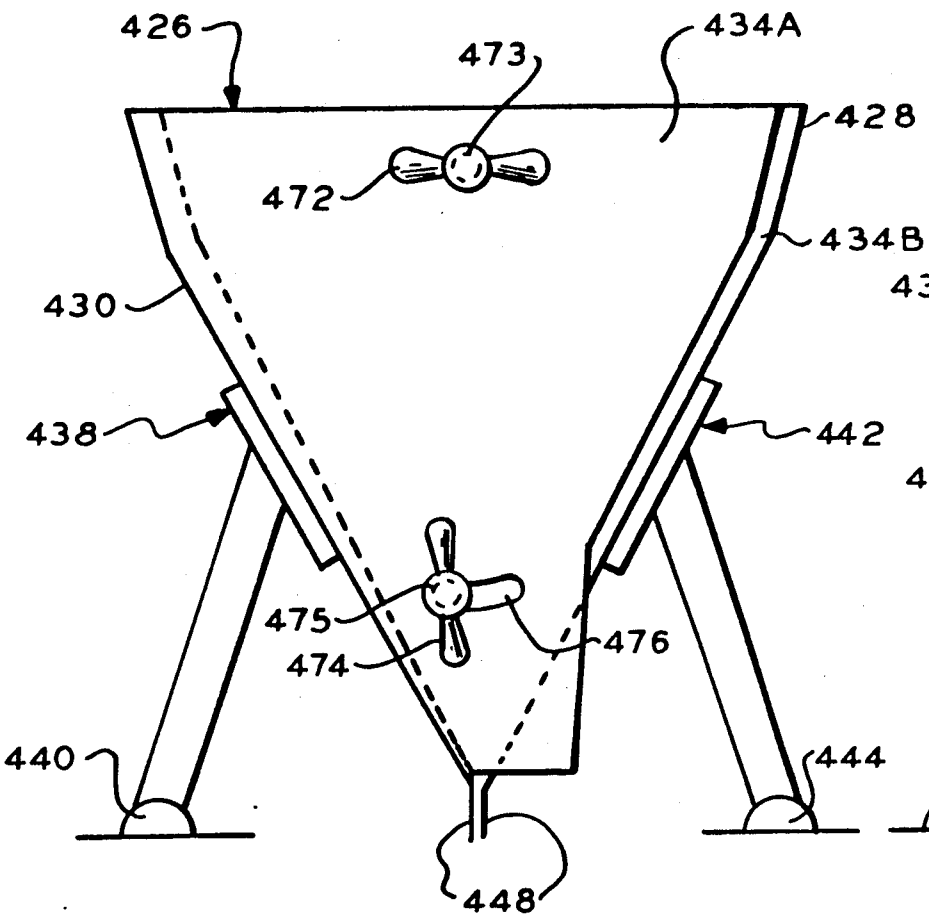
FIG. 10 is an end view of a closed hopper that is an alternate to those of FIG. 1.

FIGS. 10 and 11 illustrate an adjustable hopper, which is an alternate to hopper 26 of FIG. 1. In this Figure the reference numerals of components corresponding to those of FIG. 1 have their most significant digits changed to 4. The hopper has the same general shape as well as having two container sides 428 and 430. Each of the container sides 428 and 430 also have at opposite ends thereof generally triangular end cheeks, one of said end cheeks being shown herein as two-part, overlapping cheek assembly 434A, 434B. The opposite end of hopper 426 has a similar overlapping cheek assembly, but these are not visible in this view.

The two parts of cheek assembly 434A, 434B are pivotally connected on threaded stud 473 secured to cheek 434B. Stud 473 passes through a corresponding hole in cheek part 434A. Wing nut 472 may be tightened on stud 473 to clamp cheek parts 434A and 434B together. Another threaded stud 475 is similarly secured to cheek part 434B and passes through arcuate slot 476. Rotation about stud 473 is prevented by tightening wing nut 474 to further clamp cheek assembly 434A, 434B.

Before use, wing nuts 472 and 474 can be loosened and cheeks 434A and 434B can be swung from the position shown in FIG. 10 to that in shown in FIG. 11 or any position in between. Accordingly, the opening between guides 448 can be set to the desired interbrick spacing. Once the guide to guide spacing is set, wing nuts 472 and 474 can be tightened.

The operation of the hoppers of FIG. 1 will now be briefly described. It will be appreciated, however, that the operation of the other illustrated hoppers is substantially the same, except for the adjustability that was described already.

Initially, a mason would make a foundation layer of fresh cement. Thereafter, the mason would begin laying the bricks on the fresh cement and spacing them apart. The interbrick spacing is typically ⅜ to ½ inch. After the cement solidifies and bonds the bottom of the paving bricks, the mason then needs to fill in the joints between the paving bricks.

Hopper 10 is then filled with cement 20 and positioned as shown along the long edges of paving bricks P. The plunger can be placed against opening 16 to prevent cement flow. Thereafter, plunger PL can be lifted and pressed downwardly once or repeatedly depending upon the size of the space being filled and the consistency of the cement 20. This reciprocation forces cement to flow through opening 16 as guided by guides 18. The flat bottom of transverse bar 58 (FIGS. 3 and 4) of plunger PL pushes the cement. Were the bottom of the transverse bar pointed, it would simply slice through the cement without pushing it through opening 16. Advantageously, the up and down strokes of the plunger not only dispense the cement, but perform a mixing action that keeps the cement consistency normal and prevents setting or hardening.

The intervention of guides 18 between the paving bricks P and the pressure caused by the downward thrust of plunger PL, tightly packs cement between the bricks. Tight packing is important to prevent voids that can fill with water, which can freeze and crack the joint between bricks. The mason will reciprocate plunger PL and monitor the filling of the joint by observing the ends of the elongated opening. When the cement nearly reaches the top the hopper can be moved. Hopper 10 can be moved by grasping handles 13 and sliding the hopper along the groove between paving bricks P. When moving the hopper, plunger PL is kept against opening 16 to prevent premature cement flow.

Once hopper 10 of FIG. 1 is repositioned at another brick, plunger PL can again be reciprocated to force cement between the bricks in the same fashion. This procedure can be rapidly repeated so that bricks are neatly cemented together.

If the corners of bricks P are bevelled, the guides 18 can prevent cement from spilling to the outside of the guides. In this situation, the height of guides 18 should be lowered to prevent cement flowing onto the tops of bricks P. The height adjustment can be accommodated by selecting a hopper with deep guides or by using an adjustable height hopper such as that shown in FIG. 8.

The dispensing of cement along the short side of bricks P with hopper 26 will now be described. Hopper 26 is shown positioned in FIG. 1 between the ends of two bricks. As shown in FIG. 2, the plunger 52 can be kept with its transverse bar 50 pressed into the opening 46 to prevent cement flow. Once positioned, the plunger 52 can be reciprocated as described before to force cement to flow through opening 46, directed by guides 48. In the illustration of FIG. 2, paving bricks P are bevelled. Therefore, guides 48 serve the important role of preventing cement from flowing to the outside of the guides and atop the bricks. The guides 48 are positioned below the bevel to contain the cement.

When the space between end to end bricks is filled with cement, the plunger 52 is brought against the opening 46 to stop further cement flow. Then, the hopper 26 can be lifted and carried to the next end to end space between bricks. Again, the plunger 52 can be reciprocated to force cement into the interbrick space. The cement then must be finished on top with a brick joiner.

It is to be appreciated that various modifications may be implemented with respected to the above described preferred embodiments. The overall dimensions of the hopper can be altered depending upon the desired capacity, weight, strength, brick size, etc. The plunger dimensions can be adjusted accordingly. Also, the hopper can be fabricated from sheet metal, plate steel or other metals, depending upon the desired strength, corrosion resistance, weight, structural integrity etc. Also, the manner in which the side supports are fastened to the hopper can include welding, glueing, riveting etc. Furthermore, while skids are shown, in some embodiments simple legs with or without wheels may be used instead. Also, the shapes of the sides of the hopper can be rounded somewhat to increase the capacity of the hopper or for aesthetic reasons. Similarly, the handle shapes can be altered for aesthetic reasons or for comfort, and can be secured to the hopper sides in various ways.

Obviously many modifications and variations of the present invention are possible in light of the above teachings. It is therefore to be understood that within the scope of the appended claims, the invention may be practiced otherwise than as specifically described.

We claim:

1. A hopper for dispensing cement or mortar into the space between side by side workpieces, comprising:

a container having support means for holding said container upright, said container having an opposing pair of container sides converging downwardly to an elongated opening extending for most of the length of said container, said opening having just below it a spaced pair of guides for guiding said cement or mortar into said space between said workpieces, said opening having a longitudinal centerline, said hopper having clearance from said support means at locations lower than said guides along an upright plane intersecting said centerline.

2. A hopper according to claim 1 wherein said guides include a pair of thin parallel guiding members and wherein said hopper further comprises:

a plunger adapted for insertion into said hopper and having a handle and a transverse bar with a flat bottom, said flat bottom having about the same length as said opening.

3. A hopper according to claim 2 wherein said opposing pair of container sides each have an outside, said hopper further comprising:

a pair of support members extending from the outsides of said opposing pair of container sides for holding said container upright.

4. A hopper according to claim 3 wherein said thin parallel guiding members have an adjustable guide to guide spacing.

5. A hopper according to claim 4 wherein said pair of support members have a height adjustment means vertically adjusting said guides.

6. A hopper according to claim 5 wherein each of said pair of support members comprise a leg extending downwardly from a corresponding one of said opposing pair of container sides.

7. A hopper according to claim 6 wherein said leg has an adjustable point of attachment to said corresponding one of said opposing pair of container sides.

8. A hopper according to claim 7 further comprising:

two pairs of studs, each outwardly extending from a corresponding one of said container sides, said leg having two pluralities of holes arranged to: a) connect in pairs with one of said pairs of studs, and b) allow selection of different leg heights.

9. A hopper according to claim 8 wherein said leg comprises:

a plate having one of said pluralities of holes, said holes being arranged in two triangular patterns;

a skid;

a pair of locking fasteners for fastening said plate to a corresponding one of said pair of studs; and a pair of spaced struts connecting between said plate and said skid.

10. A hopper according to claim 7 further comprising:

two pairs of studs, each outwardly extending from a corresponding one of said container sides, said leg having two pairs of slots arranged to: a) connect in pairs with one of said pairs of studs, and b) allow selection of different leg heights.

11. A hopper according to claim 6 further comprising:

a pair of handles mounted on said container.

12. A hopper according to claim 4 wherein said opposing pair of container sides comprises:

first and second jaws each having a pair of end cheeks, said first and second jaws being perpendicularly flanked at opposite ends thereof by said pair of end cheeks, said first and second jaws being pivotally connected together at its cheeks.

13. A hopper according to claim 12 wherein said cheeks of said first and second jaws are pivotally connected at an elevated position, said first and second jaws including:

clamp means located at a lower position on at least one of said cheeks for releasably arresting relative pivoting of said jaws.

14. A hopper according to claim 1 further comprising:

a plunger adapted for insertion into said container and having a handle and a transverse bar with a compound underside including a flat bottom between a downwardly converging pair of side surfaces, said flat bottom having about the same length as said opening.

15. A hopper according to claim 14 wherein said flat bottom comprises a rectangular prismatic boss extending past said downwardly converging pair of side surfaces.

16. A hopper according to claim 1 wherein said elongated opening is between 7 to 3 inches.

17. A hopper according to claim 1 wherein said elongated opening is about 3⅜ inches.

18. A hopper according to claim 1 wherein said elongated opening is about 6¾ inches.

19. A method for dispensing mortar or cement between paving bricks with a plunger and a hopper having an elongated opening, comprising the steps of:

loading mortar or cement in said hopper;

positioning said hopper with its elongated opening between adjacent ones of said paving bricks; and reciprocating said plunger to force some of said cement or mortar through said elongated opening and between said paving bricks.

20. A method according to claim 19 wherein said hopper is halted when said plunger is reciprocated to force cement or mortar through said opening.

21. A method according to claim 20 further comprising the steps of:

advancing said hopper to a new position with its opening between adjacent ones of said paving bricks; and again reciprocating said plunger to force some of said cement or mortar through said elongated opening and between said paving bricks.

22. A method according to claim 21 wherein said step of advancing said hopper is performed by sliding said hopper along the longer side of at least one of said paving bricks to a new position while the opening remains between adjacent ones of said paving bricks.

23. A method according to claim 21 wherein said step of advancing said hopper is performed by lifting, moving and lowering said hopper to a new position adjacent the shorter side of at least one of said paving bricks where the opening is between adjacent ones of said paving bricks.

24. A method according to claim 20 wherein said step of positioning said hopper is performed to place the bottom of said opening below the top of said paving bricks.

25. A method according to claim 24 further comprising the steps of:

placing said plunger against the inside of said elongated opening to stop the flow of said cement or mortar;

advancing said hopper to a new position with its opening between adjacent ones of said paving bricks; and again reciprocating said plunger to force some of said cement or mortar through said elongated opening and between said paving bricks.

26. A method according to claim 25 wherein said step of advancing said hopper is performed by sliding said hopper along the longer side of at least one of said paving bricks to a new position while the opening remains between adjacent ones of said paving bricks.

27. A method according to claim 25 wherein said step of advancing said hopper is performed by lifting, moving and lowering said hopper to a new position adjacent the shorter side of at least one of said paving bricks where the opening is between adjacent ones of said paving bricks.

* * * * *